US008746594B2

(12) United States Patent
Challis

(10) Patent No.: US 8,746,594 B2
(45) Date of Patent: Jun. 10, 2014

(54) AIR INDUCTOR

(75) Inventor: Russell Johnson Challis, Maidenhead (GB)

(73) Assignee: A L Challis Limited, Maidenhead, Berkshire (GB)

( * ) Notice: Subject to any disclaimer, the term of this patent is extended or adjusted under 35 U.S.C. 154(b) by 241 days.

(21) Appl. No.: 13/257,634

(22) PCT Filed: Dec. 23, 2009

(86) PCT No.: PCT/GB2009/002956

§ 371 (c)(1),
(2), (4) Date: Sep. 20, 2011

(87) PCT Pub. No.: WO2010/116115

PCT Pub. Date: Oct. 14, 2010

(65) Prior Publication Data

US 2012/0006435 A1 Jan. 12, 2012

(30) Foreign Application Priority Data

Apr. 9, 2009 (GB) ..... 0906171.4

(51) Int. Cl.
*E03C 1/08* (2006.01)
*B05B 7/04* (2006.01)

(52) U.S. Cl.
USPC ..... 239/428.5; 239/433; 239/434; 137/888

(58) Field of Classification Search
USPC ..... 239/398, 428.5, 429, 433, 434; 137/602, 603, 888, 891
See application file for complete search history.

(56) References Cited

U.S. PATENT DOCUMENTS

| | | | | |
|---|---|---|---|---|
| 4,072,270 | A * | 2/1978 | Harmony | 239/428.5 |
| 5,111,994 | A * | 5/1992 | Gonzalez | 239/428.5 |
| 8,177,146 | B2 * | 5/2012 | Chen | 239/428.5 |
| 2006/0151641 | A1 * | 7/2006 | Li | 239/600 |
| 2007/0257136 | A1 * | 11/2007 | Kogelbauer | 239/533.12 |
| 2008/0272212 | A1 | 11/2008 | Denzler | |

FOREIGN PATENT DOCUMENTS

| | | | |
|---|---|---|---|
| JP | 2004-197488 | A | 7/2004 |
| WO | 92/11948 | A1 | 7/1992 |

* cited by examiner

*Primary Examiner* — Ryan Reis
(74) *Attorney, Agent, or Firm* — Howson & Howson LLP

(57) ABSTRACT

An air inductor comprises an inner sleeve having a water inlet (1) and a water outlet (2). The inner sleeve is arranged to form a venturi and has a side air inlet (3). An outer sleeve has first and second different attachment means (9, 11) at opposite ends for attachment to different plumbing fixtures. The inner sleeve can be inserted into either end of the outer sleeve so as to selectably locate the first and second attachment means (9, 11) at the water inlet (1) and water outlet (2) respectively and vice versa.

20 Claims, 1 Drawing Sheet

AIR INDUCTOR

BACKGROUND TO THE INVENTION

This invention relates to an air inductor for a water discharging device such as a shower head or tap.

Use of such a device is known to restrict and reduce the usage of water whilst still providing an apparently forceful flow. This is achieved by a venturi device combined with an air inlet which draws air into the water droplets, aerating the flow and reducing water intake without affecting the performance of the flow.

Is an aim of the invention to provide a more versatile device than has been available hitherto.

SUMMARY OF THE INVENTION

The present invention provides an air inductor comprising an inner sleeve having a water inlet and a water outlet, the inner sleeve being arranged to form a venturi, and having a side air inlet, and an outer sleeve having first and second different attachment means at opposite ends thereof, the inner sleeve being insertable into the outer sleeve from either end thereof so as to selectably locate the first and second attachment means at the water inlet and water outlet respectively and vice versa.

It will be appreciated that the outer sleeve is reversible for attachment to different plumbing fixtures, whilst retaining the venturi effect in the flow direction.

The first and/or second attachment means may comprise screw threads. In particular, the first attachment means may comprise an external (male) thread and the second attachment means may comprise an internal (female) thread.

The outer sleeve may have an outer inlet which communicates with the air inlet of the inner sleeve. In one embodiment, such communication may be via a radial gap between the inner and outer sleeves, maintained by a flange on one of said sleeves.

Stop means on one or both of the outer and inner sleeves may arrest relative motion therebetween when the inner sleeve is correctly located in the outer sleeve.

BRIEF DESCRIPTION OF THE DRAWINGS

A particular embodiment of the invention will now be described, by way of example only, with reference to the accompanying drawings, in which.

DETAILED DESCRIPTION OF PARTICULAR EMBODIMENTS

The drawings show an air inductor consisting of inner and outer sleeves which may be of plastics material such as acrylonitrile butadiene styrene.

Figure 1:
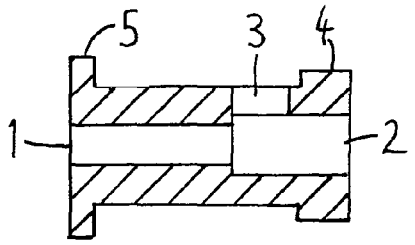
FIG. 1 is a longitudinal sectional view of an inner sleeve according to the invention.

FIG. 1 shows a inner sleeve of substantially circular cross-section having a water inlet 1 and a water outlet 2. The inlet 1 and the adjacent part of the sleeve have a smaller internal diameter than the outlet 2 and the remainder of the sleeve. An air inlet 3 is formed in a side of the sleeve.

The inner sleeve has a spacing flange 4 at the outlet 2 and a stop flange 5, of greater diameter than the spacing flange, at the inlet 1.

Figure 2:
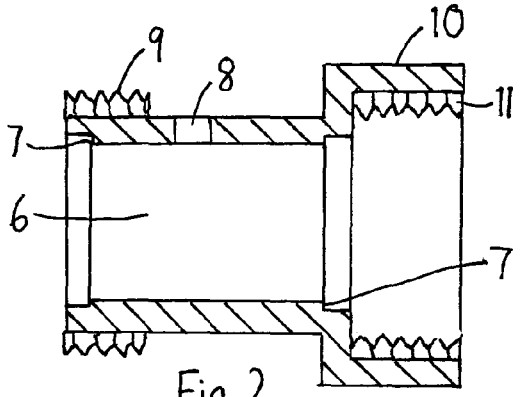
FIG. 2 is a schematic longitudinal sectional view of an outer sleeve for use with the inner sleeve of FIG. 2.

FIG. 2 shows an outer sleeve for the air inductor. The outer sleeve is also of generally circular cross-section and has a bore 6 with an internal diameter just greater than that of the spacing flange 4. The bore 6 has shoulders 7 at either end and a side air inlet 8.

At one end, the outer sleeve has a male thread 9. At the other end, the bore 6 opens into a shroud 10 formed with a female thread 11.

Figure 3:
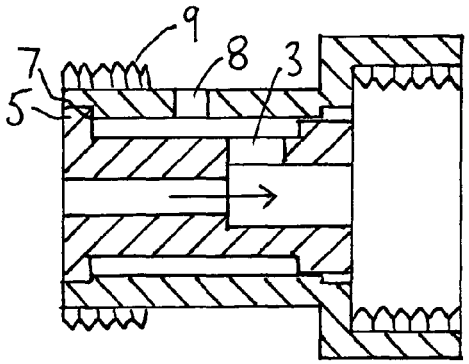
FIG. 3 shows the sleeves of FIGS. 1 and 2 assembled in one configuration to form an air inductor.

FIG. 3 shows the inner sleeve inserted into the male-thread-end of the outer sleeve. The stop flange 5 abuts the shoulder 7. With the air inductor assembled in this way the male thread 9 can be screwed onto a female threaded shower hose (not shown). Water flows in the direction of the arrow. A venturi is formed between the hose and the smaller and larger diameter sections of the inner sleeve. This draws air into the air inlets 3, 8 of the inner and outer sleeves respectively, which inlets communicate via the radial spacing between the two sleeves. The aeration reduces the water flow without affecting its apparent force.

Figure 4:
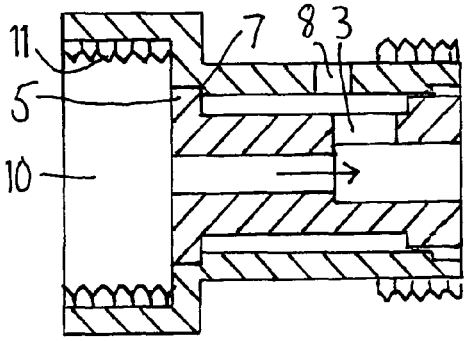
FIG. 4 shows the sleeves of FIGS. 1 and 2 assembled in a different configuration.

FIG. 4 shows the inner sleeve inserted into the female-thread-end of the outer sleeve. The stop flange 5 abuts the other shoulder 7. With the air inductor assembled in this way the female thread 11 can be screwed onto a male threaded arm (not shown). Water flows in the direction of the arrow. In this case the venturi is formed between the arm and the shroud 10 and the smaller and larger diameter sections of the inner sleeve. This again draws air into the air inlets 3, 8 of the inner and outer sleeves respectively, which inlets communicate via the radial spacing between the two sleeves. The aeration effect is achieved as mentioned above.

It will be appreciated that the invention provides an air inductor device which can be fitted to at least two different common shower attachments. This avoids the need to provide differently-configured air inductors.

The invention is useful both in new shower installations and when retrofitting an air inductor to an existing shower.

The invention claimed is:

1. An air inductor comprising an inner sleeve having a water inlet and a water outlet, the inner sleeve being arranged to form a venturi and having a side air inlet, and an outer sleeve having first and second different attachment means at opposite ends thereof for attachment to different plumbing fixtures, the inner sleeve being selectably insertable into a first one of said opposite ends of the outer sleeve so as to locate the first and second attachment means at the water inlet and water outlet respectively and being insertable into a second one of said opposite ends so as to locate the first and second attachment means at the water outlet and water inlet respectively.

2. An air inductor according to claim 1, wherein the first and/or second attachment means comprise screw threads.

3. An air inductor according to claim 2, wherein the first attachment means comprises an external (male) thread and the second attachment means comprises an internal (female) thread.

4. An air inductor according to claim 3, wherein the outer sleeve has an outer inlet which communicates with the air inlet of the inner sleeve.

5. An air inductor according to claim 4, wherein communication between the outer inlet and the air inlet of the inner sleeve is via a radial gap between the inner and outer sleeves.

6. An air inductor according to claim 5, wherein said radial gap is maintained by a flange on one of said sleeves.

7. An air inductor according to claim 6, wherein stop means on one or both of the outer and inner sleeves are arranged to arrest relative motion between said sleeves when the inner sleeve is correctly located in the outer sleeve.

8. An air inductor according to claim 1, wherein the outer sleeve has an outer inlet which communicates with the air inlet of the inner sleeve.

9. An air inductor according to claim 8, wherein communication between the outer inlet and the air inlet of the inner sleeve is via a radial gap between the inner and outer sleeves.

10. An air inductor according to claim 9, wherein said radial gap is maintained by a flange on one of said sleeves.

11. An air inductor according to claim 10, wherein stop means on one or both of the outer and inner sleeves are arranged to arrest relative motion between said sleeves when the inner sleeve is correctly located in the outer sleeve.

12. An air inductor according to claim 1, wherein stop means on one or both of the outer and inner sleeves are arranged to arrest relative motion between said sleeves when the inner sleeve is correctly located in the outer sleeve.

13. An air inductor according to claim 1, wherein the outer sleeve has a bore extending between the opposite ends of the outer sleeve, and wherein the bore has openings at each of the opposite ends of a size sufficient for the inner sleeve to be inserted therethrough into a first operating position within the bore and a second operating position in the bore which is the reverse of the first operating position, whereby, in the first operating position, the first attachment means is arranged at the water inlet for attachment to a plumbing fixture, and in the second operating position, the second attachment means is arranged at the water inlet for attachment to a plumbing fixture.

14. A method of installing an air inductor on a plumbing fixture, comprising the steps of:

providing an air inductor comprising an inner sleeve having a water inlet and a water outlet, the inner sleeve being arranged to form a venturi, and having a side air inlet, and an outer sleeve having first and second different attachment means at opposite ends thereof for attachment to different plumbing fixtures, the inner sleeve being insertable into the outer sleeve from either end thereof; and when the first attachment means is to be arranged at the water inlet for attachment to a plumbing fixture, inserting the inner sleeve into a first one of the ends of the outer sleeve so as to locate the first attachment means at the water inlet; and when the second attachment means is to be arranged at the water inlet for attachment to a plumbing fixture, inserting the inner sleeve into a second one of the ends of the outer sleeve so as to locate the second attachment means at the water inlet.

15. The method according to claim 14, wherein one or both of the first and/or second attachment means comprise screw threads.

16. The method according to claim 15, wherein the first attachment means comprises an external (male) thread and the second attachment means comprises an internal (female) thread.

17. The method according to claim 14, wherein the outer sleeve has an outer inlet which communicates with the air inlet of the inner sleeve.

18. The method according to claim 17, wherein communication between the outer inlet and the air inlet of the inner sleeve is via a radial gap between the inner and outer sleeves.

19. The method according to claim 18, wherein said radial gap is maintained by a flange on one of said sleeves.

20. The method according to claim 14, wherein stop means on one or both of the outer and inner sleeves are arranged to arrest relative motion between said sleeves when the inner sleeve is located in the outer sleeve.

* * * * *